US005590547A

United States Patent [19]

Conzelmann

[11] Patent Number: 5,590,547

[45] Date of Patent: Jan. 7, 1997

[54] YARN FEEDER DEVICE UTILIZING POSITION SENSORS TO MAINTAIN YARN WRAP

[75] Inventor: Fritz Conzelmann, Albstadt, Germany

[73] Assignee: Sipra Patententwicklungs-U.Beteiligungsgesellschaft mbH, Albstadt, Germany

[21] Appl. No.: 437,271

[22] Filed: May 8, 1995

Related U.S. Application Data

[63] Continuation of Ser. No. 230,704, Apr. 21, 1994, abandoned.

[30] Foreign Application Priority Data

Apr. 21, 1993 [SE] Sweden ..... 9301316

[51] Int. Cl.[6] ..... D04B 15/48; B65H 51/20; D03D 47/36

[52] U.S. Cl. ..... 66/132 R; 139/452; 242/47.01

[58] Field of Search ..... 66/132 R; 139/452; 242/47.01

[56] References Cited

U.S. PATENT DOCUMENTS

| | | | |
|---|---|---|---|
| 4,541,462 | 9/1985 | Tholander | 242/47.01 X |
| 4,614,311 | 9/1985 | Kakinaka | 242/47.01 X |
| 4,617,971 | 10/1986 | Hellstrom | 242/47.01 X |
| 4,687,149 | 8/1987 | Riva | 242/47.01 |
| 4,702,285 | 10/1987 | Sugita | 242/47.01 X |
| 4,715,411 | 12/1987 | Van Bogaert et al. | 242/47.01 X |
| 4,756,344 | 7/1988 | Takegawa | 242/47.01 X |
| 4,768,565 | 9/1988 | Tholandeer | 139/452 |
| 4,936,856 | 6/1990 | Ghiardo | 139/452 |
| 4,953,367 | 9/1990 | Memminger et al. | 66/132 R |
| 5,331,564 | 7/1994 | Barea | 66/132 R X |

FOREIGN PATENT DOCUMENTS

| | | |
|---|---|---|
| 0199059 | 10/1986 | European Pat. Off. . |
| 0460699 | 12/1991 | European Pat. Off. . |
| 1585298 | 11/1963 | Germany . |
| 1760600 | 6/1981 | Germany . |
| 2743749 | 10/1984 | Germany . |
| 4116497 | 11/1992 | Germany . |
| 1444455 | 7/1976 | United Kingdom . |
| 1531837 | 11/1978 | United Kingdom . |
| 8401394 | 4/1984 | WIPO . |

*Primary Examiner*—John J. Calvert
*Attorney, Agent, or Firm*—Michael J. Striker

[57] ABSTRACT

In a yarn feeder (2), the yarn feed may be effected by a yarn reserve (11) support spool (2), which is arranged to rotate by means of a motor (60). The yarn is taken up by and unwound from the spool as the latter rotates. Unwinding of the yarn reserve on the spool is not controlled. The size of the yarn reserve is monitored and yarn take-up is controlled accordingly. The unit also includes electrically contactless sensing and control devices (3), which are preferably located immediately adjacent to the rotary spool. The unit (3) is designed to sense the presence and quantity of yarn on the yarn reserve support surface (10) of the spool. The unit also controls the said motor.

28 Claims, 3 Drawing Sheets

YARN FEEDER DEVICE UTILIZING POSITION SENSORS TO MAINTAIN YARN WRAP

This is a continuation of application Ser. No. 08/230,704 filed Apr. 21, 1994, abandoned.

The present invention relates to a yarn feeder device for a textile machine, particularly in the form of a knitting machine or similar machine, in which the yarn feeder employs a yarn reserve wound on a rotary, motor-driven spool, onto which the yarn is wound as the spool rotates. The supply of yarn to the machine is accomplished by unwinding or feeding the yarn from the spool at essentially the same speed as the spool rotates, in which latter case the yarn feeder serves to eliminate variations in yarn tension between a yarn reserve and the yarn infeed point in the machine. The device also employs sensing and control devices to control the operation of the yarn feeder. The invention also relates to a method associated with the said device.

The use of a yarn feeder driven by belt from a rotating shaft in a machine such as a knitting machine is already known. By means of this drive, the yarn feeder supplies yarn to the devices which consume yarn or which perform the knitting operation in the machine, the yarn feeder consisting of a rotary spool onto which yarn from a storage reel is wound and from which yarn is fed to the machine according to the rate of consumption. The take-up and unwinding functions am accomplished at high spool speed, enabling the textile machine to operate at speeds of the order of 40 revolutions per minute.

In one method of knitting, the yarn feeder delivers a given quantity of yarn which, by the use or a gearbox and bell, bears a fixed relationship to the speed of knitting in the knitting machine (DE-OS 15 85 298, DE-PS 17 60 600). This method is known as forced or positive yarn feed since the quantity or length of yarn is independent of the pull exerted by the knitting unit on the yarn.

In another method, the yarn feeder is designed to maintain a constant yarn tension and the knitting unit is free to consume as much or as little yarn as required (DE-OS 27 43 749, EP 0 460 699, U.S. Pat. No. 4,936,356). This method is used when yarn consumption varies widely, as in the knitting of patterns. In this case, it is the function of the yarn feeder to ensure that sufficient yarn is available at all times on the yarn wheel to supply the knitting machine demand. The yarn feeder must, in this instance, be equipped with some form of measuring unit to ensure that the yarn reserve is neither too great nor too small. The yarn feeders used in the methods described above are normally equipped with some type of yarn sensor to detect interruption of the yarn supply to or from the unit. The knitting machine must normally be stopped if the yarn breaks.

In some cases, the yarn feeder is required to supply yarn at a speed proportional to the speed of the knitting machine, which is feasible using a belt drive. In accordance with the concept of the invention, the rotation of a yarn feeder should also be controllable as required by the use of a coupling or a dedicated electric motor, control being accomplished by sensing the yarn on the spool which carries the yarn reserve (DE-OS 41 16 497).

In the case of certain machines and applications, it may be required to operate the yarn feeder by belt drive during certain periods of production. It may also, for example, be desired to employ a single type of yarn feeder capable both of supplying the yarn feed, or driving the spool carrying the yarn reserve by means of a dedicated motor, and driving the spool through an alternative belt drive arrangement. In some instances, the common yarn feeder is used for dedicated motor drive or belt drive only while in other instances, both variants are used in one and the same machine. In either instance, engagement and disengagement, or activation and reactivation, of the dedicated motor drive must be feasible.

It is, therefore, an object of this invention to provide a yarn feeder device which can be used, if required, to perform different functions in different machines.

According to a further object of this invention a non-contact yarn detection is to be provided.

Yet another object of this invention is to design the yarn feeder device such that it can be used both for new machines and for modifying existing machines.

Yet another object of the invention is to design the yarn feeder device such that it is of simple construction and that it is not sensitive to dirt and contamination.

These and other objects of this invention are solved by means of a yarn feeder device for a textile machine in which the yarn feed is achieved by means of a rotary spool carrying a yarn reserve and driven by a motor, and utilising sensing and control devices to control the operation of the yarn feeder, wherein the said sensing and control devices incorporate an electrically contactless operating unit, which is wholly or partly disposed beside the rotary spool during take-up and unwinding or discharge of the yarn, which unit is also designed to sense the presence and quantity of yarn on the yarn reserve support surface of the spool and to control the motor as part of the interactive function between the yarn and the spool.

Whereas unwinding need not be monitored, the yarn reserve as such must be controlled. Yarn take-up may be controlled on the basis of the size of yarn reserve.

In one embodiment, the motor is arranged on or provided with a common drive shaft, enabling it to function in two different operating modes, the first being the normal yarn feed mode and the other the positive feed mode.

In yet another refinement of the invention concept, the unit is incorporated in the frame of an actual textile machine alongside the yarn feeder. The unit may incorporate one or more radiation or light-emitting sources, preferably in the form of light-emitting diodes (LEDs). The said sources are used to project a beam of radiation or light as appropriate onto the yarn reserve spool through a system of lenses which, in one embodiment, may consist of one or more lenses, each of which may have a large beam transmission area, for example 10–30 $mm^2$. The unit may also incorporate detecting devices to detect the beam reflected through the aforementioned system of lenses from the area of detection on the aforementioned yarn winding. In yet another embodiment, the emitting and detecting devices are arranged in parallel with each other, which is to say that the longitudinal axes of the devices are essentially aligned in parallel. Thus, the said lenses are arranged to permit the detecting devices to view the same partial surfaces on the yarn reserve support surface of the spool as those illuminated by the emitting device, despite the parallel arrangement of the emitting and detecting devices. In one embodiment, the said system of lenses may comprise surfaces arranged in a common plane which is essentially aligned in parallel with the yarn reserve support surface. Parallel alignment may also be considered as parallelism between a plane coinciding with the longitudinal axis of the spool and the said common plane. In one embodiment, the arrangement of the emitting devices, lenses and detecting devices is such that the components and their relative positions, with specific reference to the values and positions which are critical to detection, are fixed during manufacture of the unit, permitting the unit to be installed or mounted in a non-critical location beside the yarn feeder with which the unit is associated in the particular machine. Location and fixing of the components may be achieved by providing them with edges, mating surfaces, holes, guides and fixings, enabling the relative positions of the parts to be established accurately in a simple and reliable manner.

In another preferred embodiment, the incident and reflected beams in the unit are assigned asymmetrical paths through the lens system. In a further embodiment, each lens is provided with an essentially plane surface facing the yarn support surface of the spool and also with a curved surface facing away from the yarn support surface. Electronic components and circuits in the unit, together with the aforementioned emitting and detecting devices, are mounted chiefly on one and the same circuit board. The said unit may consist of a front lens support clement, a beam transmission element provided with apertures for the beam, a base or guide element for the emitting and detecting devices, and the aforementioned electronic component board and/or circuit board. A first distance between the lens support element and the base clement should be two to four times greater than a second distance, which may, therefore, range from 10 to 100 mm, between the lens support clement and the yarn support surface of the spool. This enables the lens to be located close to the yarn on the yarn support surface of the spool, affording high yarn detection sensitivity by virtue of the positions of the detecting devices, while minimising system sensitivity to particles of dirt, dust etc. The said distances permit optimum utilisation of the available characteristics of the LED, whose energy is emitted from a given area. Reduction is normally required to reproduce this energy in a given area at a point of measurement. Since it has been stipulated that the energy should be low, a small portion of the LED energy can be reproduced, enabling the LED to be located closer to the optics. Although this can be achieved by installing additional optics in front of the LED, the resultant cost is higher.

In one embodiment, the yarn feeder is belt-driven and the electronics are designed to switch out the aforementioned motor control function when belt drive is selected. The yarn support surface of the spool is provided with a varying background for the viewing optics or for the detecting devices. As a timer distinctive feature of one of the main embodiments, the beam emitted by the optics strikes the yarn winding on the yarn reserve spool essentially at right angles.

The sensing and control devices or the aforementioned unit are designed to maintain an essentially constant yarn tension ahead of the yarn consuming parts of the textile machine in question. The detecting devices may, by virtue of their locations, be arranged to focus on the yarn reserve on the spool. The variation or pattern in the spool surface enables the status of the surface to be related to the rotational speed of the motor, constituting a determining factor for the yarn feed function. For example, if a three-phase motor is used, the position of the rotor call be established from the knowledge that it will occupy one of six positions when a given phase is connected. The electronics can also detect movement and interrupt motor control, although a degree of auxiliary control may also be maintained to achieve quieter and smoother running of the motor. In this case, the control function is forced into the belt drive mode and acts as a servo function for the belt.

Since the electrical field thereby rotates in the stator, the rotor is forced to follow or to remain at standstill; in other words, the rotor will run in complete synchronism with the field. Thus, it is known that the rotor will either follow the motor connection or remain at rest. Alternatively, the motor may run at half speed, with the difference that the speed of rotation of the field and the rotational speed of the yarn wheel or spool will be high and easily detectable.

The aforementioned disturbance caused by the pins which comprise the yarn reserve spool may be used to determine the position of the spool, affording a means of controlling motor operation. The position (or pin disturbance) may itself be used to suppress pin interference in the measuring equipment.

A method according to the invention may be considered as being characterised by the fact that the unit consists of a first, plane front section, on the inside of which is mounted a system of lenses with the plane surfaces adjacent to the preferably plane outer surface of the front section and the curved surfaces facing towards the interior of the unit. The unit is also provided with an element with apertures for the beam path and with a support element for the electronic components and circuits or printed circuit boards. Thus, the said components may include beam emitting and detecting devices. The unit should preferably be provided with a base and/or control element for the beach emitting and detecting devices. The yarn feeder and unit are mounted securely on a frame section of the aforementioned machine. Alternatively, the unit may be mounted on an existing yarn feeder or vice versa. Distances which are critical to the sensing function are fixed and the relativity between the yarn feeder and unit can be made less tolerance-sensitive by virtue of the design and construction of the unit. The optics may be made in a single piece by moulding or grinding.

Although it is normally and optically preferable that both faces should be curved, one surface is made plain in the present instance for production reasons and to inhibit dust adherence.

As shown in the appended figures, the LEDs and sensors or transducers used are mounted to a holder located above the printed circuit board. Alteratively, the components may be mounted directly on the circuit board with the aid of spacers inserted between the LED/sensor and board, or may be surface-mounted.

The foregoing proposal affords advantages in that a single basic design may, if required, be used to perform different functions in different machines. A non-contact yarn detection function can be provided. Since a discrete unit containing basically the same components can be made and supplied separately, the invention can be used both for new machines and for modifying existing machines. The arrangement is non-critical and insensitive to dirt and contamination. All electronics may be mounted on one and the same board, and can be manufactured and supplied separately. The design of the unit is greatly simplified by the parallel alignment of the emitting and sensing devices, and by the non-angular lens configuration. Despite this, the system is sensitive in operation, while the arrangement permits the parallel-oriented emitting and sensing devices to illuminate and view the same spot on the yarn reserve. Reflected radiation is distributed efficiently across the entire surface of each detector. Detection of the surface may be inhibited ill the case of a yarn reserve support surface composed of rod-shaped elements. The arrangement enables the electronics to detect the different positions and directions of rotation of the motor, facilitating measurement of the yarn reserve on the spool. No special correction measures are required, for example, in the case of positive feed.

In utilising the sensing and control devices described above, it is important that the sensing and control functions are maintenance-free as far as possible and that maintenance of the said functions at frequent intervals is unnecessary. Thus, for example, the moving parts are as few as possible in number and are of a type which is not sensitive to dirt. In this context, the invention makes use of the knowledge that the sensing function may be a non-contact nature despite the occasionally rapid rotation of the yarn reserve spool.

A large number of yarn feeders of this type is available, and it is important that mounting and dismounting of the yarn feeder and the associated sensing and control units can be performed without requiring great precision. This problem is also solved by the invention, in that it is proposed that the components of the said units, the distances between them and their positions shall be fixed by providing the components with guides and mating surfaces.

It is important that the sensing function can be designed precisely for the specific application and that it is not unduly sensitive to the presence of dirt particles, dust etc., while the unit and its components is easy to manufacture and the method of assembling the unit as such is simple. All of the surfaces are plane and are positioned so as to inhibit the adherence of dust. The joints of the various components are such that penetration by dust is rendered difficult. Furthermore, the internal optics are mounted in such manner that dust must pass several layers or parts before becoming deposited on the critical surfaces.

The surface may, for example, be provided on or by means of rod-shaped elements or pins which effect the yarn separation function in a known manner, the passage of the pins in front of the point of measurement creating a signal disturbance each time a pin approaches the said point. This disturbance may be either positive, negative or amplifying in character. In the case of some yarns, the signal will decrease as the pin is covered by the yarn whereas in other instances, the signal will be amplified when tiffs occurs. The said may cause problems of measurement which make the measurement procedure difficult. This problem can also be solved by this invention.

In existing normal and forced (positive) feed systems, it has previously been proposed to use either two versions of the yarn feeder or a yarn feeder of technically complex design and operation incorporating, among other features, a two-shaft system. There is a need to employ one and the same yarn feeder for both the normal and forced feed functions, and the invention, therefore, proposes a simple design of spool and motor employing a single, solid shaft.

In one embodiment, the invention employs a lens system in which the lenses have spherical boundary surfaces. According to the invention the surfaces of this type are arranged with respect to beam-emitting and beam-receiving devices so that the latter, despite the parallel arrangement, illuminate and view the same spot on the yarn winding/surface through the lens system. Furthermore, it is essential, as part of the sensing function, that the beam can strike the yarn on the yarn reserve spool at the correct angle of incidence.

An embodiment of a presently proposed device and method exhibiting the significative charcteristics of the invention and being considered to be the best one up to now will be described below with reference to the appended drawings, of which FIG. 1 shows a yarn feeder in vertical section and an associated unit for non-contact detection of the yarn reserve and control of the yarn feeder motor;

Figure 1:
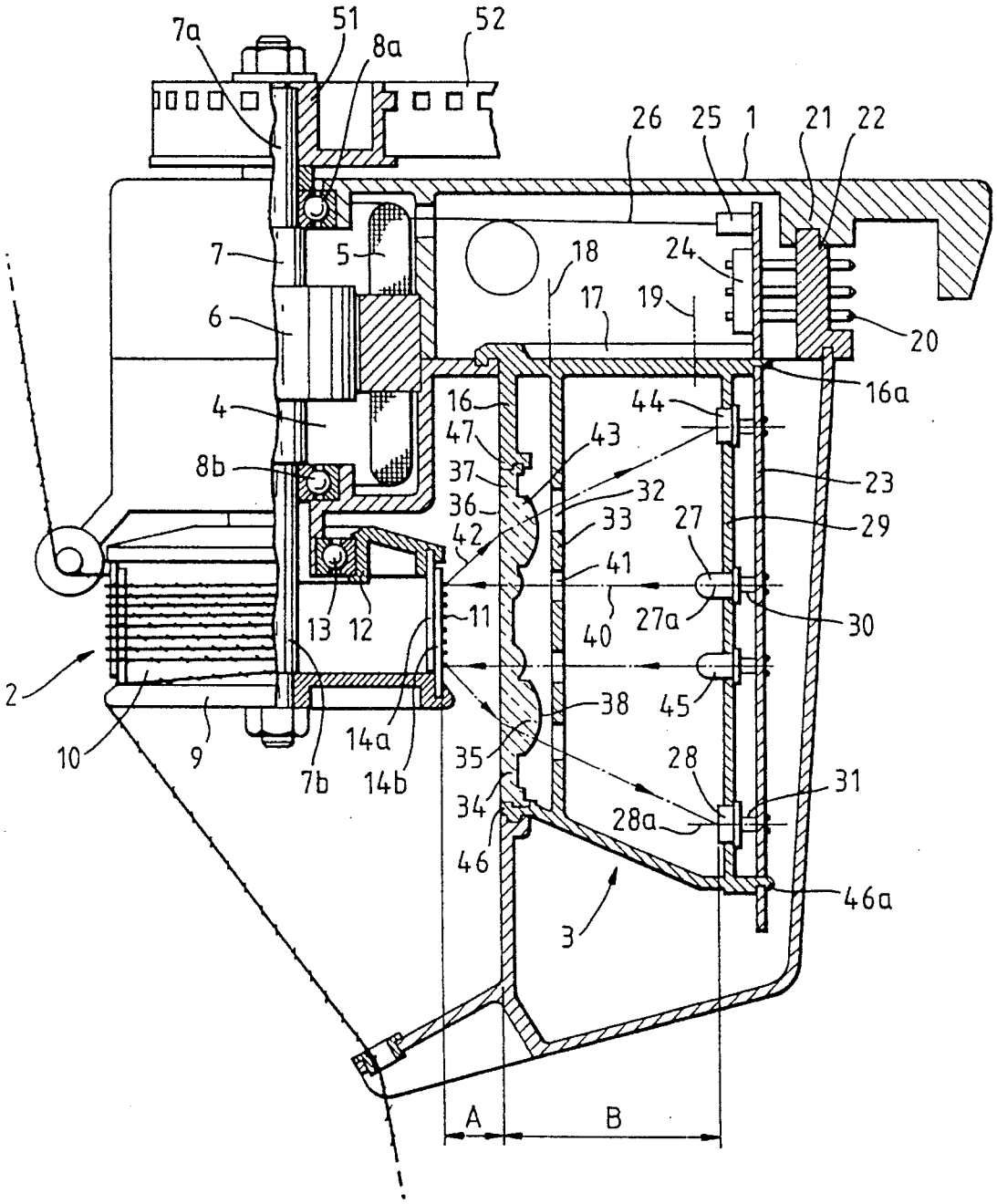

In FIG. 1, a frame in a textile machine is denoted by 1. The yarn feeder 2 is mounted on the frame by its housing. The yarn feeder is designed to interact with or incorporates a unit 3 for sensing the yarn reserve on the yarn feeder and controlling the yarn feeder motor 4. The unit 3 is also mounted on the said machine frame and comprises a component which may be mounted separately on it. The yarn feeder is equipped with a motor 4 consisting of a stator winding 5 and rotor 6 of magnetic material. The motor is supported in the frame by means of a shaft 7, which is essentially a solid shaft extending through the yarn feeder and is supported in ball bearings 8*a* and 8*b*. The shaft extends beyond the yarn feeder in the form of an upper section 7*a*. The other end 7*b* of the shaft carries a rotary spool body 9 with a yarn reserve supporting surface 10 on which the turns of yarn 11 may be wound. The rotary or rotating spool body is rigidly connected to the lower section 7*b* of the shaft. The spool may also be provided with yarn reserve feeding devices which feed the turns of yarn on the spool to the machine according as they are taken up (e.g. DE-OS 41 19 370). This function is achieved with the aid of an excentric device 12, the upper end of which is supported on or in the spool by means of a ball bearing 13. The said yarn reserve feeding devices also incorporate rod-shaped elements or pins 14*a* arranged side by side in the said excentric device 12. The said elements perform a rotational movement in a known manner. The rod-shaped elements 14*a* are spaced around the entire circumference of the excentric device. Rod-shaped elements 14*b* are arranged in similar manner in the spool body 9. The pins are provided both in the spool body 9 and excentric device 12, being mounted alternately in 9 and 12 around the spool circumference. The pins are evenly spaced around the circumference in each of 9 and 12. However, the relative distance between the pins in 9 and 12 may vary around the circumference depending on the angle and offset between the centres of rotation of the spool elements 9 yarn reserve support surface 10. As the spool rotates, the rod-shaped elements perform small rotational movements, imparting a forward feed movement to the said yarn reserve 11 from the upper sections of the rod-shaped elements, as illustrated in the figure, to the lower sections of the same elements. The relative movement between the spool elements 9 and 12, which causes the yarn to move downward in even increments of pitch, is achieved by the angle and offset between the said elements. The pitch between the turns of yarn can be varied by adjusting the relative settings of 9 and 12. This function is known and will not be described in further detail here. Further, all other known systems may be used which guarantee proper movement of the turns.

The aforementioned unit 3 is mounted on the lower parts of the frame 1. The unit 3 also incorporates a front Wall element 16 and an upper wall element 17. The unit 3 is attached to the frame section by means of screws 18 and 19 which are not illustrated specifically. The unit is furthermore provided with a terminal box 20 mounted in a recess 21 in the underside of the frame section 1 by means of a part 22. The power supply for the unit is connected to the said terminal box. The terminal box is also provided with terminals for control of the motor 6. The connections can be made in an inherently known manner using pin-type connectors or similar devices. The said terminal box is also rigidly connected to a mounting board 23 which comprises part of the aforementioned unit 3, connection being accomplished by means of a clamping device 24. The said board comprises the assembly base for electrical components and printed circuits which are not illustrated specifically. Among other components, the circuits include a terminal 25 for the motor winding, the connecting lead (looped) being indicated by 26. Apart from the said electronic components, the board 23 carries the beam-emitting sources 27 which, in the embodiment shown, take the form of light-emitting diodes (LEDs) of an inherently known type. A detecting device 28, which is also of an inherently known type, is also connected to the board. The beam-emitting sources 27 and the detecting device 28 are fixed in position by means of a base or guide element 29. The electrical connections with the beam-emitting sources and detecting devices are indicated by 30 and 31 respectively. The unit is also provided with apertures 32 for the beam path, which arrangement is afforded by the support element 33. A lens system support element 34 is mounted in front of the support element 33. The lens arrangement consists of a number of lenses 35 provided, firstly, with a plane surface which coincides essentially with a plane outer surface 37 on support element 34. Each lens is provided, secondly, with a curved surface 38 facing inward towards the interior of the unit 3 or support element 33. The front surface 37 is located at a distance A from the yarn reserve support surface 10. A distance B between the said surface 37 and the detector face or the front surface 39 of the base element 29 is two to four times greater than the distance A. The distance A may range in value from 10 to 100 mm. Alternatively, the complete optical assembly may be made in a single piece with edges, guides and joints incorporated in the transparent element 34. This element 34, which is an integral part of the complete unit, acts alike as a cover, lens and seal and, to a lesser extent, as a stiffening element. The arrangement permits the lens system to be located close to the yarn reserve winding. The beam-emitting sources 27 and the detecting devices 28 are disposed in essentially the same plane on the same side of the lens system. The longitudinal axis 27*a* of the sources 27 is essentially parallel to the longitudinal axis 28*a* of the detecting devices 28. The lens system illustrated, in which the lenses are in parallel displacement with respect to each other, enables the appropriate detecting device to view the same spot on the yarn reserve as that illuminated by its associated beam-emitting source, despite the positions of the sources 27 and detecting devices 28 and the parallel relationship between them. In FIG. 1, an emitted beam of radiation or light is represented by 40. The incident beam 40 passes through an aperture 41 in the element 33 and strikes the topmost turn of the yarn reserve on the rotary spool essentially at right angles, the said turn reflecting the beam in the direction represented by 42. The said reflected beam is refracted by a lens 43 and is returned through aperture 32 to the detecting device 44. A corresponding beam paths is established by the source 45 and the associated detecting device 28. The source 45 and the detecting device 28 view the lowermost turn of the yarn reserve on the spool. A large quantity of reflected light is received by the entire area of the detecting devices 28 and 44. The unit is provided with a lower inner wall 46 and an upper inner wall 47, in which lower and upper inner walls element 34 is clamped or mounted. The mounting board 23 is attached to the lower inner wall 46*a* and an upper wall 16*a*. Thus the unit 3 comprises a discrete unit which may be mounted on the frame. Distance B is relatively critical as regards the optical function of the unit. The locations of the apertures 32 in element 33 are similarly critical, as are the positions or the beam-emitting and detecting devices. A detecting arrangement may consist of a light-emitting diode of a given size, located at a distance from the optics, with a shutter in front, with a distance between the optics and the point of measurement, with a distance between the point of measurement and sensor lens function, and with a distance between the lens and sensor. All of these parameters are interdependent and if one is changed, the others must also normally be changed unless a lower measuring sensitivity is acceptable. All of the critical positions and distances referred to are incorporated in the unit as part of its manufacture. Distance A is less tolerance-sensitive in terms of the function as a whole.

Figure 2:
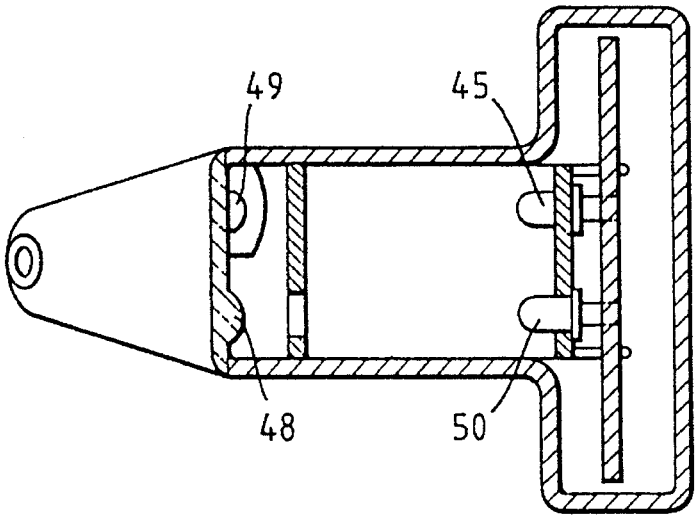
FIG. 2 shows the unit referred to in FIG. 1 in horizontal section.

FIG. 2 is intended to show the parallel displacement of the lenses 48 and 49. The figure also shows that the beam-emitting sources 45, 50 may be disposed in parallel alongside each other also in the horizontal plane, as may the detecting devices 28, 44.

It is also possible to assign two or more emitting devices to one and the same detecting device, or vice versa.

In accordance with FIG. 1, it shall be possible to drive the rotary spool by the alternative method of belt drive. For this reason, a belt pulley 51 and a belt 52 are shown in FIG. 1, the latter being connected to a drive source or drive pulley in the textile machine.

Figure 3:
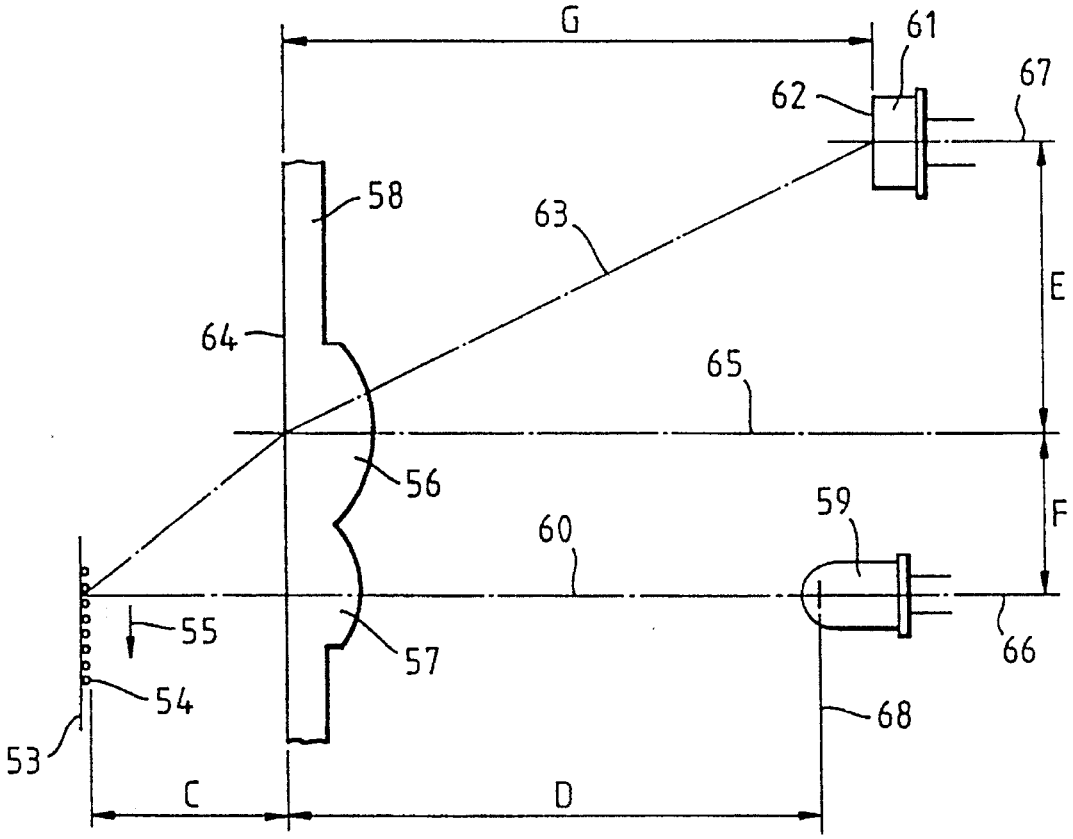
FIG. 3 is a vertical view showing the relative positions of the emitting and detecting devices, lens system and yarn reserve support surface of the rotary spool with a detectable yarn reserve.

In FIG. 3, item 53 denotes the yarn reserve support surface, the yarn reserve being represented by the yarn winding 54. The yarn is supplied from above and is wound onto the spool in the direction of the arrow 55. The figure shows two lenses 56 and 57 supported in element 58. The emitting source or, in relevant instances, the LED is indicated by 59. The beam emitted by the source may consist either of pulsed or non-pulsed radiation. A detecting device 61, the radiation detecting surface of which is denoted 62, is associated with the source 59. The beam 60 passes through the lens system and is reflected by the yarn, the reflected beam conducted to the detecting surface 62 being denoted 63. A distance between the preferably plane outer surface 64 and the yarn reserve winding 54 is designated C, the chosen value in the present instance being approximately 14 mm. A distance between the said surface 64 and the emission element in the beam-emitting source 59 is denoted D. A centre line of a lens 56 is denoted by 65, a centre line of the emitting device by 66 and a centre line of the detecting device 61 by 67. In the present instance, the chosen value of the distance D is 38.7 min. The centre lines or axes 66, 67 are essentially parallel and the detecting surface 62 is located essentially in the same plane as a plane 68 for the said emission element in the emitting device 59. A distance between the centre line 65 of the lens and the centre line 67 of the detecting device is denoted E, the chosen value in the present instance being 20.9 min. The chosen value of a distance F between the axes 65 and 66 is 11.5 mm. The beams 60, 63 pass through the lenses asymmetrically. The chosen value of a distance G between the outer surface 64 and the detecting surface is 43.7 min. The arrangement enables the emitting device 59 and the detecting device to be located on the same side of the lenses in essentially the same plane and to afford an accurate yarn detection function which is not sensitive to dirt. A plane front surface can be achieved, while the curved surfaces of the lenses can be maintained spherical, by appropriate specification of the distances A, C, F, E and G, and of the LED and detecting device areas. Despite this, direct imaging of the point of measurement by the emitting and detecting devices can be achieved with extremely low losses and, as a result, a high degree of sensitivity. Alternatively, less expensive components using weaker illumination may be used.

In the invention is proposed an arrangement with an excellent optical function, in which the locations of the light source and sensor relative to the shape and orientation of the yarn are of decisive importance to the results achieved. The position of the light source is based on the nature of the background i.e. the yarn reserve spool and its location.

Among other factors, the invention is based on the illumination of a round, reflective pin representative of one of the aforementioned pins 14*a*, 14*b*. The light is reflected with the normal to the surface midway between the incident and reflected beams. Viewed from the side, no light is reflected upward or downward if the light strikes the pin at right angles. In the normal case, however, since the pin is not completely bright and the incident light is not completely collimated, some light is scattered upward and downward in practice. Viewed from above in the longitudinal direction of the pin, it is seen that the light which strikes the centre of the pin is reflected back to the source, while that which strikes the pin on either side of the centre is reflected sideways.

Based on this, a sensor designed to detect a perfectly reflecting pin illuminated by collimated light is placed at right angles to the pin in the same plane as the light source. The use of white, multiple-ply cotton yarn affords greater freedom in locating the sensor since the surface is then far from being a perfect reflector.

Among other factors, the invention is based on the knowledge that illuminated materials and shapes, at least if round, will always reflect light back to the source as they pass in front of it. Measurement at a number of points on the rotary spool or yarn wheel is desirable in an embodiment. This requires the provision of one or more pairs of light sources and detecting devices. The normal location of such components on a printed circuit board means that the board will be positioned with its face or edge parallel to the surface of the yarn wheel or to a plane through the axis of rotation of the wheel.

One reason for this may be that the design of LEDs is such that if the components are mounted directly on the circuit board, the light beam will be emitted normally to the surface of the board. A small angular deviation can be achieved by physically bending the mounting pins (this is more or less uneconomical in the case of surface-mounted components.) The greater the angular deviation of the light beam from the normal, the more complex and expensive is the arrangement. This is also true of sensors consisting of photodiodes or other types light-sensitive components. LEDs which emit a beam parallel to the surface of the board are also available. Although it is possible to install this type of LED at an angle in the same manner as described above, the problems and the cost are similar. In the proposed embodiment, a simple optical arrangement is achieved using the same distance between all LEDs (if several are used) and the point to be illuminated. The proposed embodiment is also based on the use of a vertical and a horizontal part with the circuit board arranged in one of these two principal directions. The diodes are edge-mounted and located in a line.

The circuit board is disposed parallel to the yarn wheel axis, with the surface of the board facing the wheel. The optical assembly is also positioned parallel to the circuit board and the yarn wheel axis. The LED and sensor are aligned in different directions in relation to the point of measurement to avoid the use of expensive optics employing semi-transparent mirrors.

The LED is positioned at right angles to the point to be illuminated and at which the yarn is to be detected. The light from an LED is generated by passing a current across a PN junction. To achieve the highest possible efficiency, the actual light-generating element is extremely small, typically 0.2 to 0.4 mm square. Since the light generated is scattered in all directions, the element is mounted in a reflective holder and enclosed in a plastic element which acts as a ions to direct as much light as possible in a single direction. It has been shown hat most of the light produced by an LED is emitted from the tip, which has a diameter equal to 80% of that of the LED itself. Since an H1000 LED with a diameter of 5 mm is used in the instance described here, the diameter of the part from which the light is actually emitted is 4 mm. The amount of light scattered in different directions varies depending on the type of LED used. In this case, the device used is a Stanley type H1000 LED with an extremely small degree of scatter, which enables a small lens to be used while collecting most of the light to illuminate the point of measurement, the LED being located directly opposite this point. If the LED is positioned to one side of the lens, the lens must either be made correspondingly larger or a larger LED used, in which case the degree of scatter will be greater and it must be accepted that all of the light will not be directed to the point of measurement. The light leaves the LED from a circular area with a diameter of 4 mm. If maximum use is to be made of the light, this area must be imaged at the point of measurement. In the exemplified embodiment, since the chosen distance between the yarn wheel and the optics is 15 mm and the diameter of the desired point should be approximately 2 mm, reduction by a factor of about 2 is required. Thus, the light source should be located approximately 30 mm behind the optics and a suitable focal length reflected back to the sensor, two different lenses being used to image the LED and photodetector at the point of measurement. In the geometry chosen for the invention, the sensor lens should be located between 8 and 15 mm from the LED lens. In this case, the optimum is that the light should strike the optics and sensor at the smallest possible angle of incidence and that the lenses should be as far apart as possible. If the lenses are far apart, they may be made large and a great deal of light collected. In addition, it is easier to employ baffling to ensure that only light from the point of measurement arrives at the sensor and that none of the light scattered in the optical system is received. The optical axes of both the LED and sensor lenses are perpendicular to the yarn wheel axis. The proposed location of the LED has the advantage that the optical axis of the lens is then located concentrically in relation to the point of measurement and light source. In the instance described, since the sensor lens is located approximately 10 mm above the LED lens, its optical axis is also 10 mm above the point of measurement. This single imaging functions excellently even if the losses are somewhat higher due to the increased angle of incidence with the plane front surface of the optics. Since the ratio of the distances between the sensor and the optics and the optics and the point of measurement is approximately 2:1, the point of measurement will be enlarged by a factor of about 2. This means that the sensor must view this area with a diameter of 4 mm in order to utilise the information from the entire illuminated area. Were the sensors as small as the LEDs, additional optics would be required in front of the sensor to image this 4 mm diameter within a diameter of 0.3 mm. Although sensors of this type are available, they cannot be mounted perpendicularly on the board, but must be aligned in the direction of light emission. For this reason, since the sensor is not subject to heating problems, it may, unlike the LED, be made as large as desired. Thus, optical sensors of the photodiode type, with areas from 1 $mm^2$ up to 84 $mm^2$ are available In the equipment described, a sensor area of between 5 and 20 $mm^2$ is proposed to view most of the point of measurement. Since this type of sensor is available without a lens, it is not equally sensitive in terms of directional alignment but may be mounted parallel to the circuit board with the light impinging on the surface at an angle. Although the angle of incidence produces a certain loss, the magnitude of loss is acceptable at the angles involved. In the proposed embodiment, the sensor is located directly under or directly above the LED. There are three reasons for locating the sensor in either of these positions:

Firstly, the yarn is round and although it does not constitute a round mirror, it scatters the light in the same manner as a round, reflective surface. Tests have shown that certain yarns are detectable only with the arrangement shown. If the sensor is turned through 90°, the reflected light will be so weak that it is undetectable among the normal noise. This applies to dark, light and shiny yarns.

Secondly, the yarn is supported on round pins (rod-shaped elements). If these pins are bright and reflective, the minimum of light will be reflected into the sensor. This means that even medium-sized and light-coloured yarns can be detected without regard for the fact that the pins are in the background.

Thirdly, the yarn feeder will be wider if the sensor is to be angled downward by as much as 90°.

In certain simple applications, only one of the aforementioned sensors is required to control the yarn feeder. In this case, the sensor should be located so that the point of measurement is somewhere around the mid-point of the yarn reserve. With bright pins, this sensor location enables the pin signal to be suppressed sufficiently to make it negligible in relation to the signal from the yarn. It may also happen that the yarn used is so bright compared with the pins that even a high pin signal is relatively negligible. If the yarn wheel is rotating, dejection will be greatly simplified if the measurement bandwidth is relatively small in comparison with the frequency at which the pins pass the point of measurement, the resultant measured value being the mean of the signals from between and directly from the pins. Using a mean value of this nature, it is not unduly difficult to detect even extremely thin threads wound onto the spool in the vicinity of the point of measurement. Once the yarn has been detected in front of the detector, adequate time is available to stop the unit.

The design of the spool is critical to the efficient operation of the optical measuring system. The exemplified embodiment includes four measuring points.

The spool passes directly in front of each of the sensors. The sensors are not located directly above each other for two reasons. Firstly, the activated sensor must be located directly above or directly below the light source and space is not available to locate all of the lenses in line since these must be disposed over a large area. Secondly, the advantage of always locating a point of measurement beside a pin by cannot be achieved by displacing the points of measurement slightly. The proposed arrangement enables disturbance-free measurement to be achieved at at least one point.

The chosen design features a total of 26 pins divided between the upper and lower wheels. The spool 9 may be regarded as consisting of the said upper and lover wheels, in which the pins 14*a*, 14*b* are mounted. This, together with the fact that the system employs a three-phase motor which stops at six different points per revolution in 'on-off' control, means that a point of measurement is located between two pins each time the motor stops. The optimum spread of points is achieved by specifying a number of pins which is exactly one removed from a number evenly divisible by 6. in the present instance, 19, 23, 25 or 29 would be suitable numbers of pins. However, since the pins are divided between two wheels, the total number of pins will be even and the next most suitable number, i.e. 20, 22, 26 or 28, must be specified. In each individual wheel, the number of pins should be one removed from a number which is evenly divisible by 6, i.e. 5, 7, 11, 13, 17, 19, 23 or 25. The total number of pins is obtained by doubling this number as shown in the table below. The table shows the number of pins in one wheel, the total number of pins and the pitch between the pins expressed in degrees.

| H1 | Total | Pitch |
|---|---|---|
| 7 | 14 | 25.71 |
| 11 | 22 | 16.36 |
| 13 | 26 | 13.84 |
| 17 | 34 | 10.58 |
| 19 | 38 | 9.47 |
| 23 | 46 | 7.83 |
| 25 | 50 | 7.20 |

It has proved difficult to select a configuration of less than 14 pins since the offset between the wheels required to lift the yarn from the pins is then too great. A 22-pin configuration is satisfactory if the diameter is less than 50 mm; however, 26 pins are more suitable if the diameter is increased to 60 mm. Although it would also be feasible to use a higher number of pins, this would increase the cost of manufacture while reducing the pin spacing, in turn reducing the area available for measurement between the pins.

It should be noted that although other pin numbers are possible, this will impose additional demands on motor control or on assembly if the point of measurement is to be positioned beside a pin. A number of pins which is evenly divisible by 6, such as 24, means that the rotor will always stop in the same position relative to a pin. Relating the position of the wheel and pins to the motor phase sequence enables the point of measurement to be located relative to the pins. The advantage of an evenly divisible number of pins is that the relativity between each phase and the pins is identical; in other words, the point of measurement is located in the same position relative to a pin at all six stopping points. If the number of pins is not evenly divisible, not all of the stopping points will enable the point of measurement to be located beside a pin. The above is based on the assumption that one of the three phases is on or off and that the motor operates more or less as a stepping motor. Although better positioning can naturally be achieved throughout the revolution with a motor of this type, with magnets in the rotor and a three-phase stator, it requires continuous control of the current in the different stator windings. This calls for sophisticated current control in each of the three windings individually, making the design more expensive. Since only measurement at standstill requires positioning of the yarn wheel, coarse speed control is adequate when the wheel is taking up yarn. This may take the form of open-loop control, eliminating the need for continuous current control.

A 26-pin configuration is used in one embodiment. This means that although only one or two phases can be connected to position the point of measurement beside the pin, these two points will always occur in one or other of the phases regardless of how the yarn wheel is mounted in relation to the rotor. This allows the wheel to be mounted without fixing its position in relation to the rotor and without any need for special connection of the phases to the electronics, enabling the six most suitable motor positions to be adopted as the stopping points.

The motor chosen is a three-phase unit, in which rotation is achieved by alternating the current in the three windings in the course of a revolution. To maintain the torque constant during a complete revolution, the current in each winding must vary sinusoidally in relation to the phase angle, the phase displacement between the windings being 120°.

Acceptable motor control can be achieved by applying a steady, approximately sinusoidal current. With this form of control, the current requires to be switched at only three positions during the revolution. For maximum torque, the electrical field should lead the rotor position by 90°. A torque can be developed between the stator and rotor by applying a phase displacement to this current in relation to the relative position of the rotor in the stator. Maximum torque is developed at a phase displacement of 90°.

The position of the yarn wheel is unknown when the supply is switched on. The rotor can be made to rotate slowly by applying a small current to one of the windings. Since the three points of measurement, which are located in the area of pins, are not located in a straight line relative to the pin, the direction of rotation can be determined by the order in which the pin is detected by the different sensors. This is satisfactory if the yarn reserve is empty or if the yarn reserve is so thin that the pins can be detected through the yarn. The design of the upper section of the yarn wheel enables a signal to be received by the sensor which monitors the edge in question. The design of the edge is such that the signal increases in one direction and decreases in the other direction. Study of the variation in this signal enables the direction of rotation of the wheel to be determined. If the direction of rotation is incorrect, another winding is chosen and the correctness of rotation rechecked. When the wheel is rotating in the correct direction, it is necessary to control the current only until the wheel moves smoothly to a position determined by the imposed electrical field. When the wheel stops, the position of the rotor is relation to the imposed electrical field is known. The electrical field may then be advanced until the yarn wheel is in a position at which the point of measurement is midway between two pins. This position may be predetermined by the position in which the yarn wheel is mounted on the rotor in relation to the stator and the connection of the latter. Alternatively, the position may be determined by measuring the reflection from the pins and determining their positions relative to the six positions at which the yarn wheel stops during a revolution. This measurements may be carried out directly on the pins if there is no yarn on the wheel or if the yarn is so thin that the pins are visible through it. In the example described, the upper yarn wheel is provided with reflective surfaces located in a predetermined position relative to the pins. The position can be determined by viewing these surfaces even if the yarn wheel is full of yarn.

Using the method described above, the yarn can be detected using the sensor to detect the light reflected or scattered by the yarn. When the yarn is used, the reserve is emptied and no light is returned to the sensor, since the latter does not image any part of the background which is also illuminated by the light source associated with it. In the case of extremely thin yarns, it has been shown that the variation in light received by the sensor from a wheel with and without yarn is small compared with other variations in light level, such as those caused by fluorescent lights supplied with a.c. at 50 Hz. The background variations must be filtered out to detect thin yarns. This is achieved by modulation/coding of the signal to enable the sensor to discriminate between light from the LED and light from other sources.

The light from the LED can be modulated at a certain frequency and filtering of the signal from the sensor is achieved using a bandpass filter which passes only signals or the LED frequency. In an alternative method according to the invention, a combination of digital and analogue methods is employed, in which an analogue multiplexer is used to connect the sensor signal at reversed polarity to an LP filter with the LED extinguished for a specified period, for example 0.5 milliseconds. All signals are then disconnected from the LP filter and the LED is fired. When the LED displays a steady beam, the sensor signal is connected to the LP filter by means of an analogue multiplexer for 0.5 milliseconds. If the background light is assumed to remain substantially unchanged during this millisecond or so, the remaining signal will consist of the light reflected by the yarn from the light source and background, less the background component. In other words, the remaining component will consist only of light emitted by the system source and scattered by the yarn. This method functions excellently when the yarn wheel is at rest and there is no pin at the point of measurement. By synchronising the pins, it is possible to ensure that measurement takes place only between them. The reflecting surfaces at the edge of the upper wheel, one such surface being provided for each pin, are used for synchronisation purposes. When a reflector registers, the position of that pin in relation to the point of measurement is known. Measurement of the time interval between the two previous points enables the times between which measurement can be carried out to be determined. In certain cases involving thin yarns, it is possible to use a yarn wheel without the reflecting surfaces and to use the pins themselves for synchronisation. In this case, it is appropriate to use the lower sensor since this is usually free of yarn. Although it is much easier to use the upper edge for control purposes since there is no interference from yarn, disturbances due to passing yarn can be suppressed by a combination of satisfactory processing of the lower sensor signal and extrapolation, enabling the motor and measurement functions to be monitored and controlled without using the reflectors on the upper wheel (on which a reflector is provided for each pin). The position of the yarn wheel can be determined with a resolution of 27 degrees by counting the number of pins. An extra reflector is provided between two pins at one point around the circumference; in other words, there are 13+1 reflectors around the circumference. The extra reflector is used for resynchronising if the sensor should, for any reason, miss a reflector or if double counting should occur. This extra reference is not available in those instances in which the upper edge is not used and the lower sensor, which measures at the lowest point of the yarn wheel, is used instead. It is also possible to measure when synchronism has been lost since the motor torque will then decrease; in other words, a higher current will be required to maintain the same speed. It is possible to ascertain if the current demand will increase or decrease by adding or subtracting positions on a trial basis. If this adjustment results in a fall in current demand, the count may be assumed with certainty to be incorrect and compensation can be applied to correct the error. If the current demand does not fall, the increased power demand is due to increased load and not to a faulty phase change caused by incorrect position measurement.

A motor of this type is usually equipped with some type of position sensor, an extremely common arrangement being three Hall elements separated by a displacement of 120°, which assume the 'High' state during half of the revolution and occupy a fixed position with respect to the stator, so that a change in the signal from these sensors indicates that a change of phase connection is required. 'Trapezoidal' control of the 3-phase motor is possible with this type of sensor. The same position information can be obtained using the optical system described above without the need fit extra sensors in a special position relative to the stator. Since all of the electronics are mounted on the circuit board, the motor requires no wiring or additional sensor components. The optics required can be combined with the components already needed for detecting the yarn.

As described above, measurement can be carried out with the yarn stationary, by adjusting the phase of the yarn wheel so that the point of measurement is to the side of the pin and the signal is filtered so that background variations do not interfere with measurement.

Measurement as described above can be carried out when the yarn wheel rotates, by synchronising the measurement with the pins and by synchronising on the pins or patterned upper edge. Since three sensors are provided, measurement can be carried out at three points on the wheel: at the upper edge, at the mid-point and at the upper edge. In the simplest case, it may be sufficient to measure at the mid-point. The yarn wheel should stop when the machine is at rest and yarn is positioned in front of the sensor. If the knitting machine is using yarn and the area in front of the middle sensor becomes empty, the wheel should start immediately to take up yarn. In this event, the yarn feeder should run quickly up to full speed to replenish the reserve and prevent it from being emptied completely. In all cases, replenishment should be accomplished at a speed sufficiently high to ensure that the reserve is filled faster than yarn can be consumed by any knitting machine, in order to ensure that the yarn feeder overtakes the knitting machine speed at all times. Once the yarn at the mid-point is fully replenished, the yarn feeder must be stopped to ensure that it is not over-filled.

A microprocessor may be used as controller. The yarn feeder may be stopped in various ways. The control system monitors the number of turns which it has supplied from the instant the yarn disappears from in front of the middle sensor to the instant at which it reappears, in addition to the time taken for winding on the yarn. Based on this information, the control system can compute the yarn speed during this period. Thus, a suitable control strategy is to reduce the speed of the yarn wheel to a value immediately below the computed value and, if the yarn does not disappear from in front of the sensor, the yarn feeder must reduce the speed to zero before more turns are taken up than can be accommodated from the mid-point of the yarn wheel down. Since the spacing between the turns of yarn can be determined beforehand, the yarn feeder knows in advance the maximum number of turns which may be supplied before it must stop. In the best case, the knitting machine will continue to use yarn at a reasonably steady rate, in which instance the yarn will disappear from in front of the middle point of measurement and the control system will increase the speed to bring the yarn in front of the sensor again. This method of increasing the speed when the yarn disappears from in front of the sensor and reducing the speed when it disappears enables the yarn feeder to maintain a reasonably steady speed using only one point of measurement at the mid-point of the yarn reserve. If too many revolutions elapse from the instant that the yarn disappears from the point of measurement, the yarn feeder speed must be increased rapidly to its maximum before the yarn reserve is exhausted. Similarly, the yarn feeder must be stopped quickly if yarn is present at the point of measurement and too many revolutions are required before the yarn disappears from the point of measurement despite the reduced speed. Both of these cases will arise if the yarn consumption suddenly increases or decreases beyond the estimated average rate. In the case in which the lower sensor is located in a sufficiently high position or the angular speed is sufficiently low, the yarn feeder may delay stopping when the yarn reserve is so large that it covers the lower point of measurement.

A signal indicating that the machine is running should normally be present at a terminal in the terminal box to which the electrical supply to the unit is connected. This signal is essential to the detection of yarn breakage between the yarn feeder and the knitting machine. The design of a knitting machine is such that it always consumes a certain quantity of yarn when it is operating. If the yarn wheel becomes full as far as the lower point of measurement and the yarn feeder stops, the yarn should disappear from this point after a certain time if yarn is being used. If the machine is operating, as indicated by the aforementioned signal, and the yarn disappears from this sensor after an interval, the yarn must have broken. This means that the 'Machine running' signal must not be active at speeds so low that insufficient time is available for the yarn at the lowest point to be consumed during the specified, preprogrammed time. Similarly, the upper point of measurement may be used to detect breakage of the yarn between the bobbin and the yarn feeder. This is an extremely simple case in that the knitting machine must be stopped if there is no yarn in front of the sensor.

All three sensors should preferably be synchronised with the rotation so that measurement is carried out to the side of the pins in all cases and is, thereby, unaffected by pin reflections.

Figure 4:
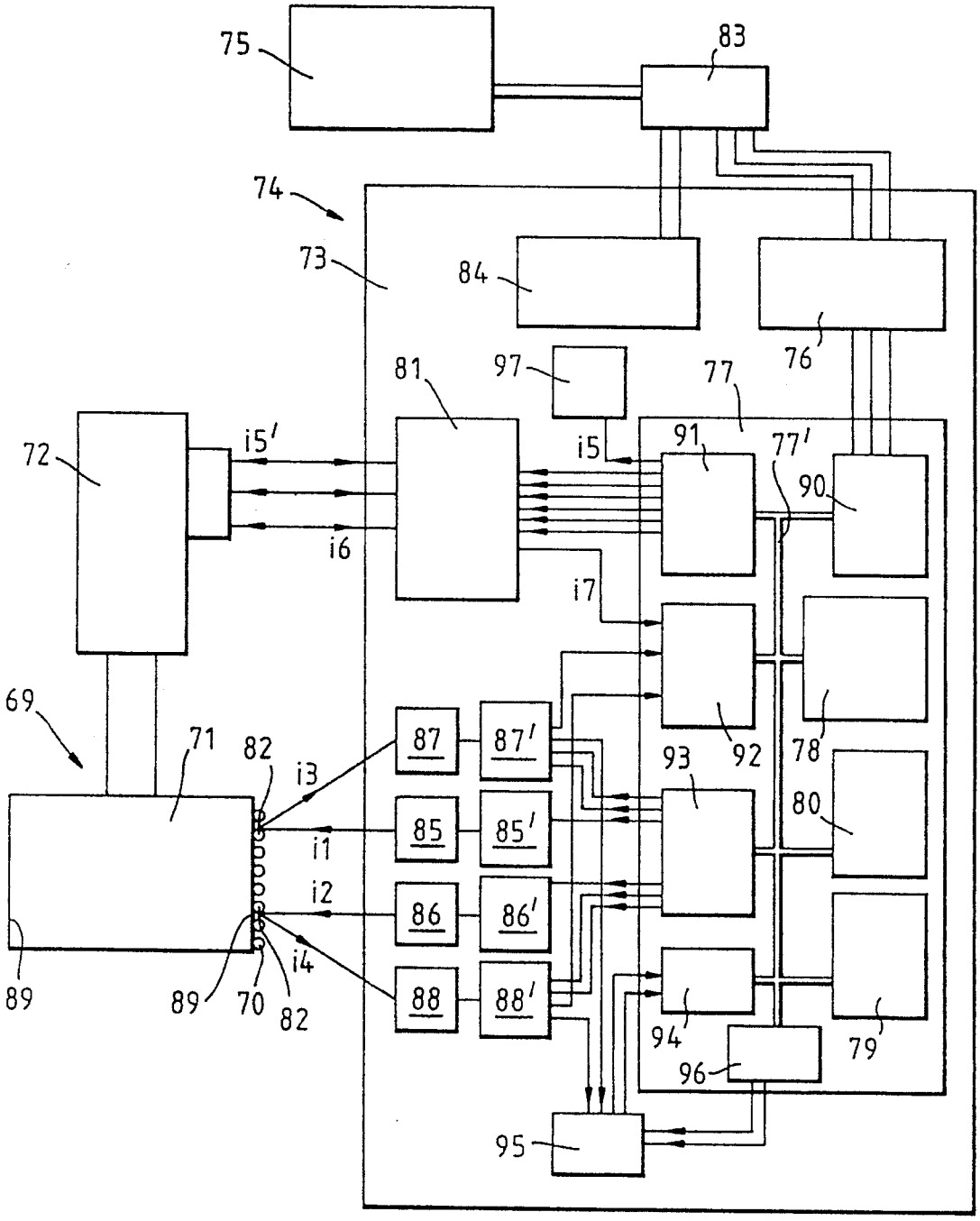
FIG. 4 is a schematic showing the sensing and control unit electronics, including the emitting and detecting devices.

As illustrated in FIG. 4, the electronics consist of the following main components: power pack, yarn reserve meter, yarn wheel/motor position detector, indicating equipment and some type of analogue and logical signal processing to achieve the desired function. In FIG. 4, the rotary parts of the yarn feeder are indicated symbolically by 69 and the rotary spool carrying the yarn reserve 70 by 71. The motor is designated 72. The electronics are grouped on a mounting board 73. In one embodiment, the electronics and equipment of the unit 74 are connected to the textile machine control unit 75.

A connector 83 carries both signals between the unit and the machine control unit 75, and the power supply to the unit. A unit 85 contains the parts required to supply the necessary power to the various components of the unit 74. The power pack is of a design normally used when it is desirable to use a single type of supply, such as 24 V d.c., for the complete system. The type of supply is determined by the motor demand since this is the largest power consumer. A d.c. supply, at a voltage determined by the motor power demand, is suitable when the electronics are used to control the motor position and speed. An a.c. supply could also be used if each unit were to incorporate a rectifier; however, since conversion is carried out at central level in the present instance, the voltage obtained is directly suitable for the motor requirements. Unit 84 may incorporate some type of filter to suppress the effects of outside interference and conversely, to ensure that internal faults or disturbances cannot be transmitted with the supply and interfere with other units. In most cases, some form of voltage conversion is also provided to obtain a voltage suitable for the processors and analogue measuring system. All of these functions can be realised using known technology to achieve the highest possible efficiency in relation to cost.

In principle, the motor power stage consists of a number of transistors, which connect the supply to the motor windings in a number of ways. In the case described, the motor used is provided with a rotor of magnetic material and with a stator with three windings. The number of magnetic poles in the rotor and the number of poles in the stator can be varied by means of technology which is known from the manufacture of this type of motor. The three windings may be regarded as interconnected at a common point and the stator has three leads, each of which is connected to a pair of transistors, so that the lead can be connected to the power supply earth i6 or the d.c. supply i5'. This supply to 81 is not shown in the figure since it is executed in a known manner. The type of transistor may vary; however, it is normally of the MOS type, although IGBT and bipolar transistors may also be used. The particular type chosen depends on the voltages and powers to be controlled. In the instance described, the transistors are controlled either in the fully conducting or fully non-conducting mode. A transistor which possesses extremely low resistance when in circuit and is completely blocked when disconnected is used in the proposed embodiment. The transistor switching time is as short as possible in view of interference generation. A suitable .choice in an application of this nature is a MOS N-type transistor which has an extremely high resistance (a leakage of less than 1 mA) when disconnected and a resistance of less than 0.1 ohm when in circuit. Although on/off control of these transistors can, in principle, be achieved by means of signals i5 directly from digital outputs, based on the software values, the signal levels are modified in many cases. Special drive circuits such as the IR2121 type by International Rectifiers, or others performing the same function, may also be used. Special drive circuits of similar type for motor control, such as the type ETD3002 by Portescap, are also available, reducing the demands on the microprocessor in terms of motor monitoring and control. Satisfactory motor control is possible in this application without monitoring the winding currents. However, current measurement provides an additional check, while improving efficiency and acceleration. Control can be improved in terms of speed regulation merely by measuring the total current in the windings. For positioning purposes, the current must be measured in at least two of the windings for full current control. In the simplest case, the current is measured by measuring the voltage drop across a known resistance. In FIG. 4, this voltage drop is denoted by i7 and is fed to the A/D converter for use in that area of the software which controls the motor current.

The sensor consists of simple, conventional electronic devices 85' and 86', which fire and extinguish the associated LEDs 85 and 86 by means of a digital control signal so that the light signals i1 and i2 can be activated and deactivated. The LED may be of a type which emits a visible light or a light of lower wavelength within the infrared range invisible to the eye. Basically the same electronics may be used for same for the four light sources, only two of which are shown in the figure.

While the sensor 87 and 88, which detects the light i3 and i4 in the instance described is a photodiode, other types of photosensitive sensor may be used. The photodiode 87 and 88 is connected to, an amplifier of conventional type, the signal from which is passed through some form of filter selected to ensure that the important information is obtained from the sensor. A combination of analogue and digital methods is used in the instance described to provide the filtering function. The amplification and filtering functions are denoted by 87' and 88' in the figure. The algorithm which may be used to achieve the filtering function is described below.

If the area of measurement 82 and 82' on the yarn reserve is located at a sufficient distance from a pin:

Fire LED

Wait 50 microseconds

Close switch to feed sensor signal directly to filter

Wait (measurement time) microseconds

Extinguish LED

Wait 50 microseconds

Close switch to feed inverted sensor signal to filter

Wait 50 microseconds

The measurement time specified above may typically be 100 microseconds. The time specified may vary somewhat depending on the value which affords the best and simplest measurement. The 50 microsecond waiting times shown are chosen to allow sufficient time for firing and extinguishing the LED completely before measurement is actually carried out. If the LED is extremely fast and the yarn is not self-illuminating, this time may be less than 1 microsecond. In this context, the most important factor is that the measurement time should be so short that the background light does not have sufficient time to vary in the course of the measuring sequence described above. For example, at extremely high speeds (30 revolutions per second), the time between two pins is 1280 microseconds, during which three measurements must be carried out, allowing for the fact that the pins themselves account for a proportion of the time. If a in passes in 300 microseconds at this speed, the time remaining is 980 microseconds, corresponding to three intervals of 325 microseconds. In a measurement as described above, the chosen measurement time must be less than 113 microseconds or, if two measurements are to be carried out, less than 31 microseconds. These times may be subject to variation depending on a number of technical factors. For example, it may be possible to carry out both measurements concurrently if they do not interfere with each other or if measurements of the illuminated point are carried out individually, with concurrent measurement of the non-illuminated area at all points of measurement. The order of measurement may also be affected in those cases in which the points of measurement are not located in the same relationship to the pin. In this case, one or two points of measurement may be located opposite a pin while the others are located to the side. As the yarn wheel and pins rotate, it may be convenient to synchronise on the pin itself or on the reflective surfaces at the top of the wheel. Since the speed is relatively constant, it is possible, after synchronisation, to define the measurement areas in time, enabling measurement to be carried out across several pins before resynchronisation is required.

Slow variations in the background light can be eliminated by filtering as already described. Thus, the signal obtained is a measure of the light from the LED which is scattered back to the detector. The geometry of the optical system is such that only light which strikes the yarn should be detectable. Thus, the signal is a measure of the light from the yarn and will be zero if no yarn is present. The magnitude of the signal will increase with the size of the area covered by the yarn and the amount of light reflected by the yarn. In a case in which the signal is to be interpreted by a processor, it may be convenient to convert it into digital form with the aid of an analogue to digital (A/D) converter 92 and to determine whether or not yarn is present in the area of measurement by comparison with digitally stored reference values. The manner in which this information is used for motor control is described above. In a case in which processor 77 is not used, the signal may conceivably be fed to a comparator, and the motor started and stopped directly depending on whether the signal is above or below a specified reference value. In the case in which a processor is not used, this reference value may be a permanent setting or may be adjustable by means of some type of potentiometer.

The signal from the photodiode amplifier may, in certain cases, or in parallel with the aforementioned filter, be connected to a comparator 95 which, in the case of certain processors, may be an integrated sub-function. This is particularly suitable for the signal from the upper edge of the yarn wheel since this is normally used only to synchronise with certain fixed positions around the circumference. In the case in which a processor is used for control, the digital signal from the comparator is connected to a digital input 94 with an interrupt function which can resynchronise all other functions to the detected position of the yarn wheel. When a processor is used, the signal level to the comparator may be adjusted by means of an analogue output 96, which may be of the PWM type.

Other types of motor, such as a four-phase motor or a d.c. motor with brushes, may also be used. In most cases, however, these are not an optimum choice in terms of overall cost and function.

The microprocessor 77 should preferably be a type in which most of the necessary components are integrated in one and the same circuit, such as an NEC 75512, 78052 or 78328, a Siemens SAB83C166 or equivalent from the same or other manufacturers. Units of this type are provided with RAM 79 and ROM 80, of which the ROM may be stitch-programmed or of the OTP, UVPROM or 'flash' type. Execution of the program stored in 80 is performed in 78, which communicates with memories and other units through a bus 77'. The type of processor circuit described also includes digital inputs 94, digital outputs 91 and 93, analogue inputs 92 and analogue output 96. Since information exchange with 75 can take several forms, this unit 90 contains digital-type inputs and/or outputs or some type of serial data communication. The analogue output 96 may also be of the PWM type, which is digital in character but which, externally by means of a filter function, can replace a pure analogue output. The function of the circuit will not be described in detail since both it and its performance are described in suppliers' documentation.

In most cases, the unit and control electronics can function without communication with the machine control unit 75. Normally, however, the unit should deliver a signal to unit 75 when yarn breakage is detected so that the unit in question can be stopped and the fault corrected. The output of this type is normally of the 'open collector' type so that all units can perform this signalling function using one and the same conductor. In certain cases, the system may deliver a 'Run' signal indicating that the machine is running and, thereby, using yarn. Thus, the unit can use this signal to determine if there is a break in the yarn between the yarn wheel and machine by recording the yarn consumption from the wheel. Another signal which may be used is a synchronising signal from the central control system when it is required to drive the unit motor synchronously at the machine speed. Normally, all of these signals are of the digital type with a voltage between 0 and 24 V; however, analogue signals and serial data communication may also be used to solve the same problem. On detecting a system fault, the unit should normally indicate the fault both by means of the signal described above and by means of some type of optical indication, such as an LED 97, enabling service personnel to locate the faulty unit (which may be one of ninety).

The control unit should normally ensure that the yarn reserve contains yarn at all times by winding on yarn when the reserve is too small or stopping the motor when the reserve is too big. In certain cases, the yarn wheel may be driven by belt, in which case it will be impossible to start the motor, since the shaft is locked to the belt. If this is the case and the unit is not displaying a 'Run' signal, the unit will interpret the condition as indicating that it should be belt-driven. In this event, the unit will interrupt all motor control by shutting down all of the aforementioned transistors so that no current is supplied to the stator windings. When the unit subsequently receives a 'Run' signal, it will expect the yarn wheel to be driven by the belt. If this is not the case, the unit will make a fresh attempt to replenish the yarn reserve by operating the motor. If motor operation is then impossible, the unit will indicate the condition as a fault. Although motor control is not required with belt drive, it may sometimes be advantageous to allow the motor to act as a servo for the belt drive in order to achieve a more uniform and/or lower belt force. Even if motor control is not required in this case, the yarn must still be monitored for breakage. This is achieved by allowing the upper optical sensor to verify that yarn is being supplied at all times and to monitor the upper point of measurement. Similarly, the lower detector can be used to monitor the yarn for breakage on the other side, since yarn should never be present within that measurement area under normal conditions.

The invention is not limited to the exemplified embodiment described above, but may be modified within the framework of the appended patent claims and invention concept.

I claim:

1. A yarn feeder device for textile machines, comprising a rotary storage member having a yarn reserve supporting surface provided with a varying background of reflective and non-reflective surfaces; a motor for rotating said storage member; and sensing and control means taking into account said varying background and recognizing a presence or absence of yarn at least partially against the non-reflective surface of said yarn reserve supporting surface so as to control said motor such that a selected quantity of yarn can be maintained on said yarn reserve supporting surface.

2. A yarn feeder device as defined in claim 1, wherein said varying background provided by said yarn supporting surface includes a plurality of rod-shaped elements which are spaced at intervals from each other.

3. A yarn feeder device as defined in claim 2, wherein said elements are formed so that they impart a forward feed action to the yarn when said rotary storage member rotates.

4. A yarn feeder device as defined in claim 1, wherein said sensing and control means include at least one sensing means for sensing a preselected portion of said yarn reserve supporting surface so as to determine whether or not the yarn is present or absent on said preselected portion.

5. A yarn feeder device as defined in claim 4, wherein said sensing and control means is formed so that said varying background is taken into account by controlling said motor such that said rotary storage member only comes to a standstill after having been rotated in such a manner that said preselected portion is located between two of said elements.

6. A yarn feeder device as defined in claim 4, wherein said sensing and control means is formed so that said varying background is taken into account by comparing first and second output values of said sensing means, said first output values being delivered when said preselected portion is located on one of said elements and said second output values being delivered when said preselected portion is located between two of said elements.

7. A yarn feeder device as defined in claim 6, wherein said elements are spaced from one another by a predetermined spacing, said portion being smaller in width than said spacings between said elements.

8. A yarn feeder device as defined in claim 6, wherein said sensing and control means is formed so that it determines a mean value resulting from said first and second output values.

9. A yarn feeder device as defined in claim 4, wherein said sensing and control means is formed so that said varying background is taken into account by using only output values delivered when said preselected portion is located between two of said elements.

10. A yarn feeder device as defined in claim 1; and further comprising a frame, said rotary storage member being rotationally mounted on said frame, at least a portion of said sensing and control means being also mounted on said frame and disposed at a side of said storage member.

11. A yarn feeder device as defined in claim 4, wherein said sensing and control means include at least a first radiation emitting source, a first radiation receiving detector means, and a first lense means for sensing said preselected portion.

12. A yarn feeder device as defined in claim 4, wherein said sensing and control means include at least a second radiation emitting source, a second radiation receiving detector means and a second optical lense means for sensing an upper portion of said rotary storage member to verify whether or nor the yarn is supplied to said yarn storage member.

13. A yarn feeder device as defined in claim 4, wherein said sensing and control means include at a first and a second radiation emitting source, at least a first and a second radiation emitting detector means, and at least a first and a second lense means associated with said sources and said detector means, said first source, said second detector means and said first detectors and said first lense means being arranged for sensing said preselected portion, while said second source, said second detector means and said second lense means being arranged for sensing an upper portion of said rotary storage member to verify whether or not the yarn is supplied to said yarn storage member.

14. A yarn feeder device as defined in claim 13; and further comprising a frame including a front wall element and a transparent support element, said support element being inserted into said front wall element and composed of a single piece which comprises all of said lense means.

15. A yarn feeder device as defined in claim 14, wherein said support elements have plane outer surfaces, said lense means having plane outer surfaces coinciding with said plane outer surfaces of said support element, said lense means also having curved inner surfaces.

16. A yarn feeder device as defined in claim 14, wherein said frame includes a base element mounting said first and second sources and said first and second detector means.

17. A yarn feeder device as defined in claim 16, wherein said front element and said base element are mounted in said frame so that distances between said lense means, said sources and said detector means and also a distance between said lense means, said sources and said detector means from said storage member are fixed by said frame.

18. A yarn feeder device as defined in claim 13, wherein said sources and said detector means have axes which are parallel to each other.

19. A yarn feeder device as defined in claim 18, wherein an axis of one of said sources and an axis of an associated one of said detector means are substantially arranged in a common vertical plane.

20. A yarn feeder device as defined in claim 16, wherein said sensing and control means have electrical components and circuits, said front element and said base element together forming a unit; and further comprising a mounting board for mounting said electrical components and said circuits, said mounting board being a part of said unit.

21. A yarn feeder device as defined in claim 16; and further comprising a support element having apertures, said support element being arranged between said front wall element and said base element.

22. A yarn feeder device as defined in claim 4, wherein said preselected portion is a turn of the yarn on said yarn reserve support surface, said sensing and control means emitting a beam which impinges on said turn substantially at a right angle.

23. A yarn feeder device as defined in claim 11, wherein said preselected portion is a turn of the yarn, said detector means being arranged such that it is focused onto said turn.

24. A yarn feeder device as defined in claim 13, wherein said preselected portion is a turn of the yarn, said detector means being arranged such that it is focused onto said turn.

25. A yarn feeder device as defined in claim 2; and further comprising a common shaft on which said rotary storage member and said rotor are mounted; and a pulley with said drive shaft so that said rotary storage member rotatable by controlling said motor.

26. A yarn feeder device as defined in claim 1; and further comprising a common shaft on which said rotary storage member and said rotor are mounted; and a pulley with said drive shaft so that said rotary storage member rotatable by positively rotating said pulley.

27. A yarn feeder device as defined in claim 25, wherein said sensing and control means is formed so that a control of said motor is interrupted when said pulley is positively rotated.

28. A yarn feeder device as defined in claim 26, wherein said sensing and control means is formed so that a control of said motor is interrupted when said pulley is positively rotated.

* * * * *